US009812068B2

(12) United States Patent
Zhu

(10) Patent No.: US 9,812,068 B2
(45) Date of Patent: Nov. 7, 2017

(54) METHOD, DEVICE AND SYSTEM OF DETECTING UNIFORMITY OF THICKNESS OF A DISPLAY SCREEN

(71) Applicant: BOE Technology Group Co., Ltd., Beijing (CN)

(72) Inventor: Jinye Zhu, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 93 days.

(21) Appl. No.: 14/443,527

(22) PCT Filed: Oct. 11, 2014

(86) PCT No.: PCT/CN2014/088387

§ 371 (c)(1),
(2) Date: May 18, 2015

(87) PCT Pub. No.: WO2015/180367

PCT Pub. Date: Dec. 3, 2015

(65) Prior Publication Data

US 2016/0049120 A1 Feb. 18, 2016

(30) Foreign Application Priority Data

May 29, 2014 (CN) ..... 2014 1 0234495

(51) Int. Cl.

| | |
|---|---|
| ***G09G 3/34*** | (2006.01) |
| ***G09G 3/20*** | (2006.01) |
| ***G09G 3/36*** | (2006.01) |
| ***G09G 3/00*** | (2006.01) |

(52) U.S. Cl.

CPC ..... *G09G 3/3406* (2013.01); *G09G 3/006* (2013.01); *G09G 3/2003* (2013.01); *G09G 3/36* (2013.01);

(Continued)

(58) Field of Classification Search

None

See application file for complete search history.

(56) References Cited

U.S. PATENT DOCUMENTS 6,362,802 B1 * 3/2002 Fujiwara ..... G06T 1/0007 345/87
7,471,355 B2 * 12/2008 Watanuki ..... G02B 6/0061 349/62

(Continued)

FOREIGN PATENT DOCUMENTS

CN 1081250 A 1/1994
CN 102252859 A 11/2011

(Continued)

OTHER PUBLICATIONS

Mar. 4, 2015—(WO) International Search Report—App PCT/CN2014/088387—Eng Tran.

*Primary Examiner* — Soo Park
(74) *Attorney, Agent, or Firm* — Banner & Witcoff, Ltd.

(57) ABSTRACT

A method, a device and a system of detecting uniformity of thickness of a display screen are provided. The detecting method includes extracting preset brightness curves for each of moire stripes when the display screen displays a monocolor picture; calculating an average position coordinate in a preset direction for each of the preset brightness curves; calculating a deviation value of a position coordinate in the preset direction of discrete points on each of the preset brightness curves with respect to the average position coordinate; for each of the preset brightness curves, when the deviation value exceeds a preset allowable deviation range, determining a thickness abnormal position of the display screen according to the coordinates of the discrete points corresponding to the deviation values. By this detecting (Continued)

method, a thickness abnormal position of a display screen can be accurately detected, and the controllability of the products can be improved.

9 Claims, 7 Drawing Sheets

(52) U.S. Cl.
CPC ..... *G09G 2320/0233* (2013.01); *G09G 2320/0626* (2013.01); *G09G 2360/145* (2013.01)

(56) References Cited

U.S. PATENT DOCUMENTS

| | | | | |
|---|---|---|---|---|
| 8,320,658 | B2 * | 11/2012 | Tanizaki | G06T 7/0004 348/177 |
| 9,506,875 | B2 * | 11/2016 | Zhu | G01N 21/956 |
| 2009/0175530 | A1 * | 7/2009 | Sjostrom | G01N 21/956 382/152 |
| 2015/0377798 | A1 * | 12/2015 | Zhu | G02F 1/00 356/601 |

FOREIGN PATENT DOCUMENTS

| | | | |
|---|---|---|---|
| CN | 102450005 | A | 5/2012 |
| CN | 102706295 | A | 10/2012 |
| CN | 103595986 | A | 2/2014 |
| CN | 103645036 | A | 3/2014 |
| CN | 104019752 | A | 9/2014 |
| JP | S4931828 | B1 | 8/1974 |

* cited by examiner

METHOD, DEVICE AND SYSTEM OF DETECTING UNIFORMITY OF THICKNESS OF A DISPLAY SCREEN

The application is a U.S. National Phase Entry of International Application No. PCT/CN2014/088387 filed on Oct. 11, 2014, designating the United States of America and claiming priority to Chinese Patent Application No. 201410234495.4 filed on May 29, 2014. The present application claims priority to and the benefit of the above-identified applications and the above-identified applications are incorporated by reference herein in their entirety.

TECHNICAL FIELD

At least one embodiment of the present invention relates to a method, a device and a system of detecting uniformity of thickness of a display screen.

BACKGROUND

With the development of the technology, 3D display, especially, naked eye 3D display has become the inevitable tendency in the display field. With the naked eye 3D display device, by using the character of optical parallax between the two eyes of a human, without any assistant device (such as 3D glasses, helmet), a vivid stereoscopic image having space and depth can be provided.

SUMMARY

At least one embodiment of the present invention provides a method, a device and a system of detecting the uniformity of the thickness of a display screen, so that the thickness abnormal position of the display screen can be accurately detected, and the controllability of the product can be improved.

At least one embodiment of the present invention provides a method of detecting uniformity of thickness of a display screen, including: extracting preset brightness curves of every moire stripe when the display screen displays a monocolour picture; calculating an average position coordinate in a preset direction for each of the preset brightness curves; calculating a deviation value of position coordinate in the preset direction for preset discrete points on each of the preset brightness curves with respect to the average position coordinate; and for each of the preset brightness curves, when the deviation value exceeds a preset allowable deviation range, determining a thickness abnormal position of the display screen according to the coordinates of the discrete points corresponding to the deviation value.

At least one embodiment of the present invention further provides a device of detecting uniformity of thickness of a display screen, including: a extracting module configured to extract preset brightness curves of every moire stripe when the display screen displays a monocolour picture; a first calculating module configured to calculate an average position coordinate in a preset direction for each of the preset brightness curves; a second calculating module configured to calculate a deviation value of position coordinate in the preset direction for preset discrete points on each of the preset brightness curves with respect to the average position coordinate; and a determining module configured to, with respect to each of the preset brightness curves, determine a thickness abnormal position of the screen according to the coordinates of the discrete points corresponding to the deviation value, when the deviation value exceeds a preset allowable deviation range.

At least one embodiment of the present invention further provides a system of detecting uniformity of thickness of a display screen, including: an image sensing module having a lens center provided opposite to a screen central point position of the display screen configured to obtain moire stripe brightness image when the display screen displays a monocolour picture and to convert the moire stripe brightness image into a digital signal; a control module signally connected with the image sensing module and configured to extract preset brightness curves for every moire stripe; calculating an average position coordinate in a preset direction for each of the preset brightness curves; calculating a deviation value of position coordinate in the preset direction for preset discrete points on each of the preset brightness curves with respect to the average position coordinate; and for each of the preset brightness curves, when the deviation value exceeds a preset allowable deviation range, determining a thickness abnormal position of the display screen according to the coordinates of the discrete points corresponding to the deviation value; and an output module signally connected with the control module and configured to output the thickness abnormal position.

BRIEF DESCRIPTION OF THE DRAWINGS

In order to clearly illustrate the technical solution of the embodiments of the invention, the drawings of the embodiments will be briefly described in the following; it is apparent that the described drawings are only related to some embodiments of the invention and thus are not limitative to the invention.

DETAILED DESCRIPTION

To make objects, technical details and advantages of the embodiments of the invention apparent, technical solutions according to the embodiments of the present invention will be described clearly and completely as below in conjunction with the accompanying drawings of embodiments of the present invention. It is apparent that the described embodiments are only a part of but not all of exemplary embodiments of the present invention. Based on the described embodiments of the present invention, various other embodiments can be obtained by those of ordinary skill in the art without creative labor and those embodiments shall fall into the protection scope of the present invention.

Figure 1:
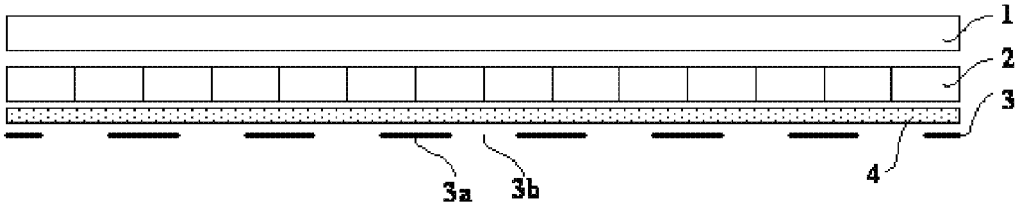
FIG. 1 is a schematic structural diagram of a naked eye 3D display device.

FIG. 1 is a schematic diagram showing the structure of a naked eye 3D display device. As shown in FIG. 1, the naked eye 3D display device includes a display panel 2, a backlight source 1 located at a back side of the display panel 2, and a liquid crystal grating device 3 located at a front side of the display panel 2, the display panel 2 is adhered to the liquid crystal grating device 3 by a layer of glue 4. The display panel 2 includes left eye sub-pixels for providing left eye images and right eye sub-pixels for providing right eye images, the liquid crystal grating device 3 is an optical device including light shielding areas 3*a* and light transmitting areas 3*b* periodically alternately arranged. The basic principle of the naked eye 3D display device in FIG. 1 is that the backlight source 1 provides backlight for the display panel, the light emitted from the left eye sub-pixels and the right eye sub-pixels of the display panel 2 is incident into different fields of view through the light transmitting areas 3*b* of the liquid crystal grating device 3, and the left eye and the right eye of a viewer are located in the different fields of view and thus stereoscopic feeling is generated.

The inventor of the present invention notices that the display panel is adhered with the liquid crystal grating device by a layer of glue, and the uniformity of the thickness of the glue layer will directly influence the uniformity of the thickness of the naked eye 3D display screen, and furthermore, influence the quality of the display images. Therefore, it is desired to detect thickness abnormal position of the display screen by the naked eye 3D display screen manufacturer.

In order to accurately detect the thickness abnormal position of the display screen and improve controllability of the products, at least one embodiment of the present invention provides a method, a device and a system of detecting uniformity of thickness of the display screen. The detecting method includes extracting preset brightness curves for every moire stripe when the display screen displays a monocolour picture; calculating an average position coordinate in a preset direction for each of the preset brightness curves; calculating a deviation value of position coordinate in the preset direction for preset discrete points on each of the preset brightness curves with respect to the average position coordinate; and for each of the preset brightness curves, when the deviation value exceeds a preset allowable deviation range, determining a thickness abnormal position of the display screen according to coordinates of discrete points corresponding to the deviation value. In the embodiments of the present invention, the thickness abnormal position of the display screen is determined according to the state of the moire stripes, thus the detection result is relatively accurate, and the controllability of the products can be improved.

It is noted that the preset brightness curves for the moire stripes can be the lowest brightness curves for the moire stripes or curves at approximate lowest brightness. When the detection is performed by using the approximate lowest brightness curves for the moire stripes, the brightness of these curves can be set according to the particular situation, such as contrast of the display screen.

The moire stripes are interference stripes liking water wave, is manifestation of the principle of beat, and most of the moire stripes include longitudinal stripe patterns. Thus, in at least one embodiment, the preset direction is the lateral direction, the present invention is not limited thereto. For example, when the moire stripes include lateral stripe patterns, the preset direction can be the longitudinal direction, and when the moire stripes include oblique stripe patterns, the preset direction can be a direction perpendicular to the oblique stripes.

In order to make the object, technical solution and advantages of the present invention become more clear, an example that the lowest brightness curve is taken and the preset direction is the lateral direction is provided, so that a method, a device and a system of detecting uniformity of thickness of a display screen as provided by the embodiments of the present invention are further described in details.

Figure 2:
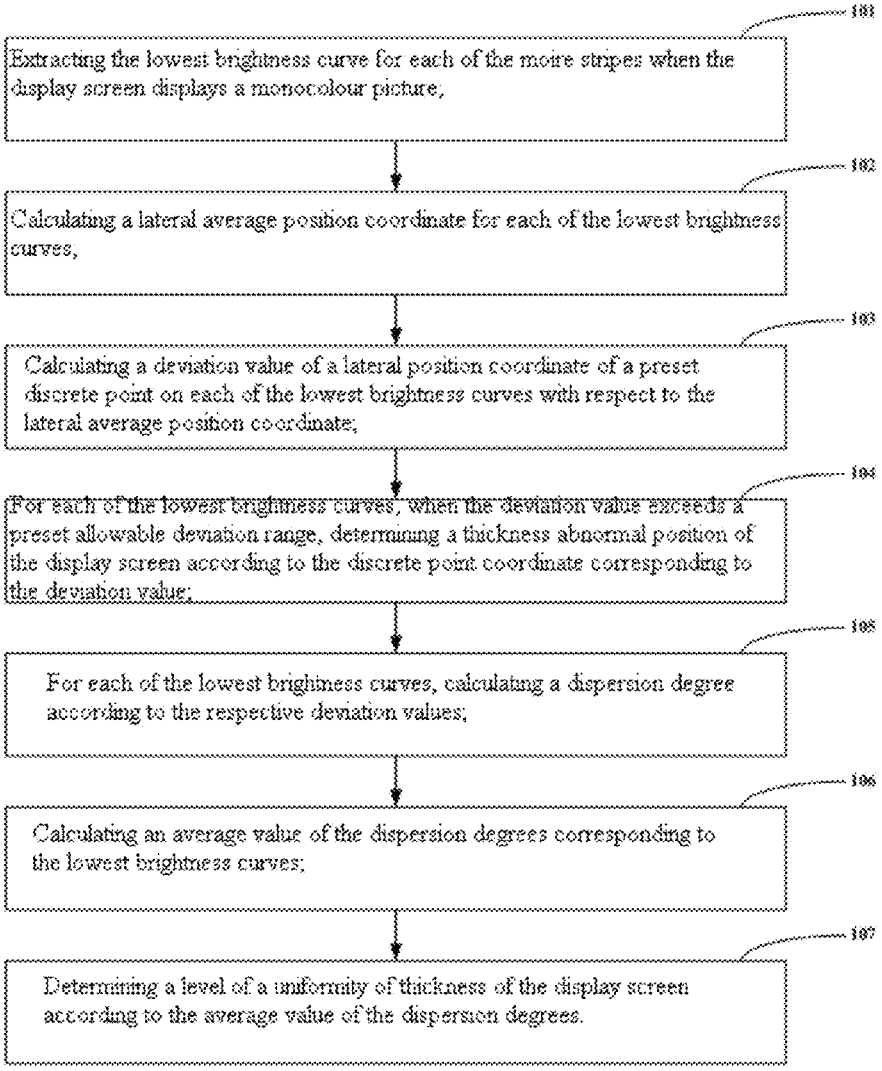
FIG. 2 is a schematic flowchart diagram showing a method of detecting uniformity of thickness of a display screen according to an embodiment of the present invention.

As shown in FIG. 2, a method of detecting uniformity of thickness of a display screen as provided by at least one embodiment of the present invention includes steps of:

Step 101, extracting the lowest brightness curve for each of the moire stripes when the display screen displays a monocolour picture.

Step 102, calculating a lateral average position coordinate for each of the lowest brightness curves.

Step 103, calculating a deviation value of a lateral position coordinate of a preset discrete point on each of the lowest brightness curves with respect to the lateral average position coordinate.

Step 104, for each of the lowest brightness curves, when the deviation value exceeds a preset allowable deviation range, determining a thickness abnormal position of the display screen according to the discrete point coordinate corresponding to the deviation value.

In at least one embodiment, the monocolour picture is a white color picture, so that a relative clear moire stripe image can be captured by the image sensing module, as the moire stripe is a black stripe, and thus it is helpful to improve the accuracy of the detection.

In the method provided by the embodiment of the present invention, the thickness abnormal position of the display screen can be determined by the moire stripe state, so that the detection result is relatively accurate, and the controllability of the products can be improved.

There is no limitation on the type of the display screen, for example, it may be a naked eye 3D display screen, and it includes a display panel and a liquid crystal grating device adhered by a layer of glue. It is appreciated that the thickness abnormal position of the display screen is just the thickness abnormal position of the glue layer, and furthermore, the display screen may also be a touch panel, a liquid display screen, or the like including the two adhered units.

In an embodiment, the method may further includes the following steps.

Step 105, for each of the lowest brightness curves, calculating a dispersion degree according to the respective deviation values.

Step 106, calculating an average value of the dispersion degrees corresponding to the lowest brightness curves.

Step 107, determining the level of a uniformity of thickness of the display screen according to the average value of the dispersion degrees.

The allowable deviation range and the level of the uniformity of the thickness of the display screen can be set according to a standard in the relative industry or the related experience. For example, the level of the uniformity of the thickness of the display screen can be divided into four levels including excellent, good, common and bad. In this embodiment, by determining the level of the uniformity of the thickness of the display screen according to the average value of the dispersion degree, it is possible to accurately evaluate the performance of the product, and to improve the controllability of the products.

Figure 3:
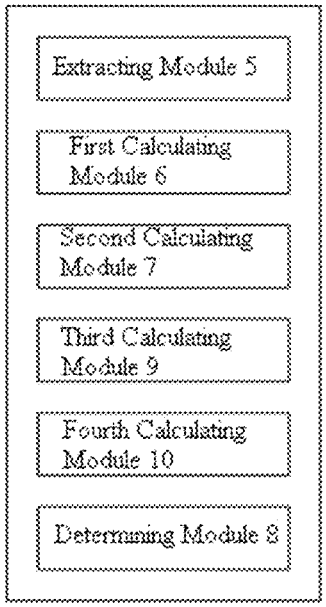
FIG. 3 is a schematic structural diagram of a device of detecting uniformity of thickness of a display screen according to an embodiment of the present invention.

As shown in FIG. 3, based on the same invention idea, at least one embodiment of the present invention further provides a device of detecting uniformity of thickness of a display screen, the device includes a extracting module 5, a first calculating module 6, a second calculating module 7 and a determining module 8. The extracting module 5 is configured to extract the lowest brightness curve for each of the moire stripes when the display screen displays a monocolour picture. The first calculating module 6 is configured to calculate a lateral average position coordinate for each of the lowest brightness curves. The second calculating module 7 is configured to calculate a deviation value of lateral position coordinate of preset discrete points on each of the lowest brightness curves with respect to the lateral average position coordinate. The determining module 8 is configured to, with respect to each of the lowest brightness curves, determine a thickness abnormal position of the display screen according to the coordinate of the discrete point corresponding to the deviation value when the deviation value exceeds a preset allowable deviation range.

In an embodiment, the detecting device may further include a third calculating module 9 and a fourth calculating module 10. The third calculating module 9 is configured to, with respect to each of the lowest brightness curves, calculate dispersion degree according to the deviation values. The fourth calculating module 10 is configured to calculate an average value of the dispersion degrees corresponding to the lowest brightness curves. The determination module 8 is further configured to determine a level of the uniformity of the thickness of the display screen according to the average value of the dispersion degrees.

In at least one embodiment, the monocolour picture is a white color picture. In the detecting device provided by the embodiment of the present invention, the thickness abnormal position of the display screen can be determined by the state of the moire stripes, so that the detection result is relatively accurate, and the controllability of the products can be improved.

Figure 4:
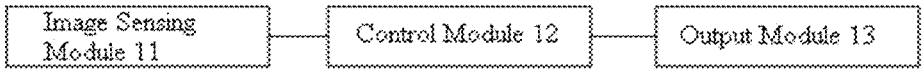
FIG. 4 is a schematic structural diagram of a system of detecting uniformity of thickness of a display screen according to an embodiment of the present invention.

As shown in FIG. 4, based on the same invention concept, at least one embodiment of the present invention further provides a system of detecting uniformity of thickness of a display screen, and the system includes an image sensing module 11, a control module 12 and an output module 13. The image sensing module 11 has a lens center provided opposite to the position of the central point of the display screen, configured to acquire a brightness image of the moire stripes when the display screen displays a monocolour picture, and convert the brightness image of the moire stripes into a digital signal. The control module 12 is signally connected with the image sensing module 11, and is configured to extract the lowest brightness curve for each of the moire stripes; calculate a lateral average position coordinate for each of the lowest brightness curves; calculate a deviation value of lateral position coordinate of a preset discrete point on each of the lowest brightness curves with respect to the lateral average position coordinate, and with respect to each of the lowest brightness curves, when the deviation value exceeds a preset allowable deviation range, determine a thickness abnormal position of the display screen according to the coordinate of the discrete point corresponding to the deviation value. The output module 13 is signally connected with the control module 12 and is configured to output the thickness abnormal position.

There is no limitation on the type of the display screen, for example, it may be a naked eye 3D display screen, a touch panel, a liquid crystal display screen, and the like. The detecting system determines the thickness abnormal position of the display screen according to the moire stripe state, so that the detection result is relatively accurate, and the controllability of the products can be improved.

In at least one embodiment, the monocolour picture is a white color picture, so that a relative clear moire stripe image can be captured by the image sensing module. As the moire stripes include black stripes, thus it is helpful to improve the accuracy of the detection.

The image sensing module 11, for example, may employ CCD (Charge Coupled Device, CCD in abbreviation). The CCD is a semiconductor device, and is capable of converting an optical image into a digital signal.

The output module 13 for example may be a display or a voice device, it facilitates the operator to accurately identify thickness abnormal position of the display screen.

In an embodiment, the control module 12 may further be configured to calculate dispersion degrees according to deviation values with respect to each of the lowest brightness curves, calculate an average value of the dispersion degrees corresponding to the lowest brightness curves, and determine the level of the uniformity of the thickness of the display screen according to the average value of the dispersion degrees. And the output module 13 may also be configured to output the level of the uniformity of the thickness of the display screen. By determining the level of the uniformity of the thickness of the display screen according to the average value of the dispersion degrees, it is possible to accurately evaluate the performance of the product, and to improve the controllability of the products.

Figure 5A:
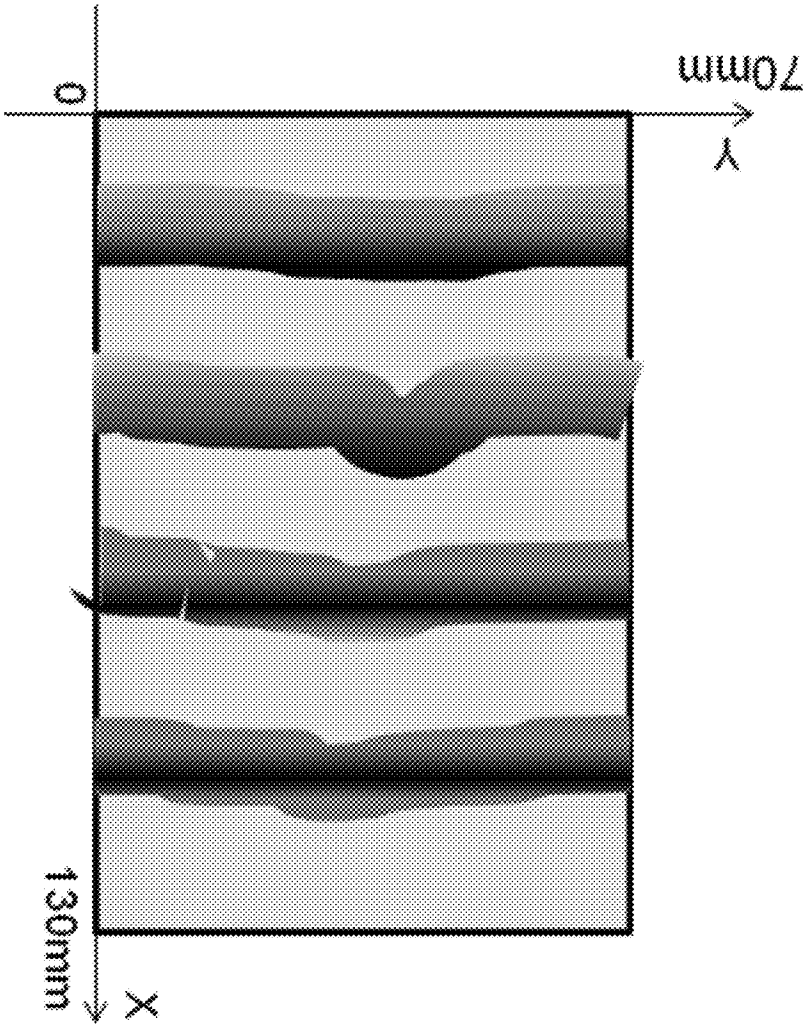
FIG. 5*a* is a schematic diagram showing the moire stripe on the display screen.
Figure 5B:
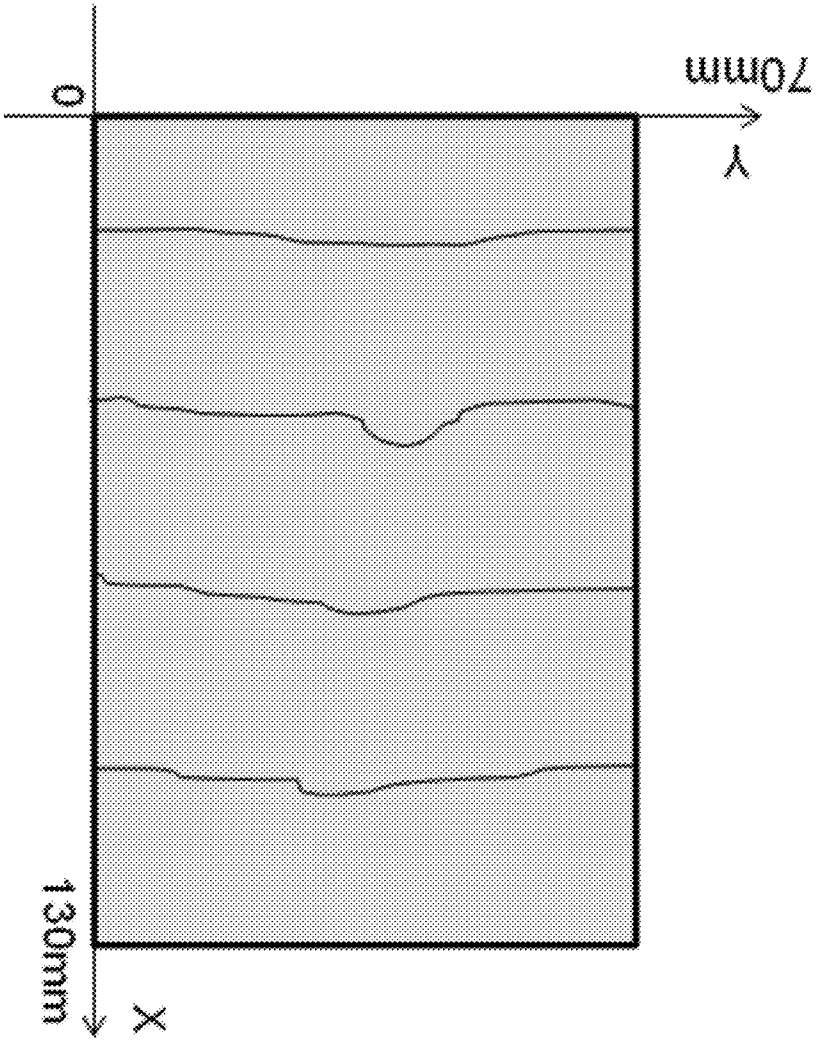
FIG. 5*b* is a schematic diagram showing the lowest brightness curves for each of the moire stripes.
Figure 5C:
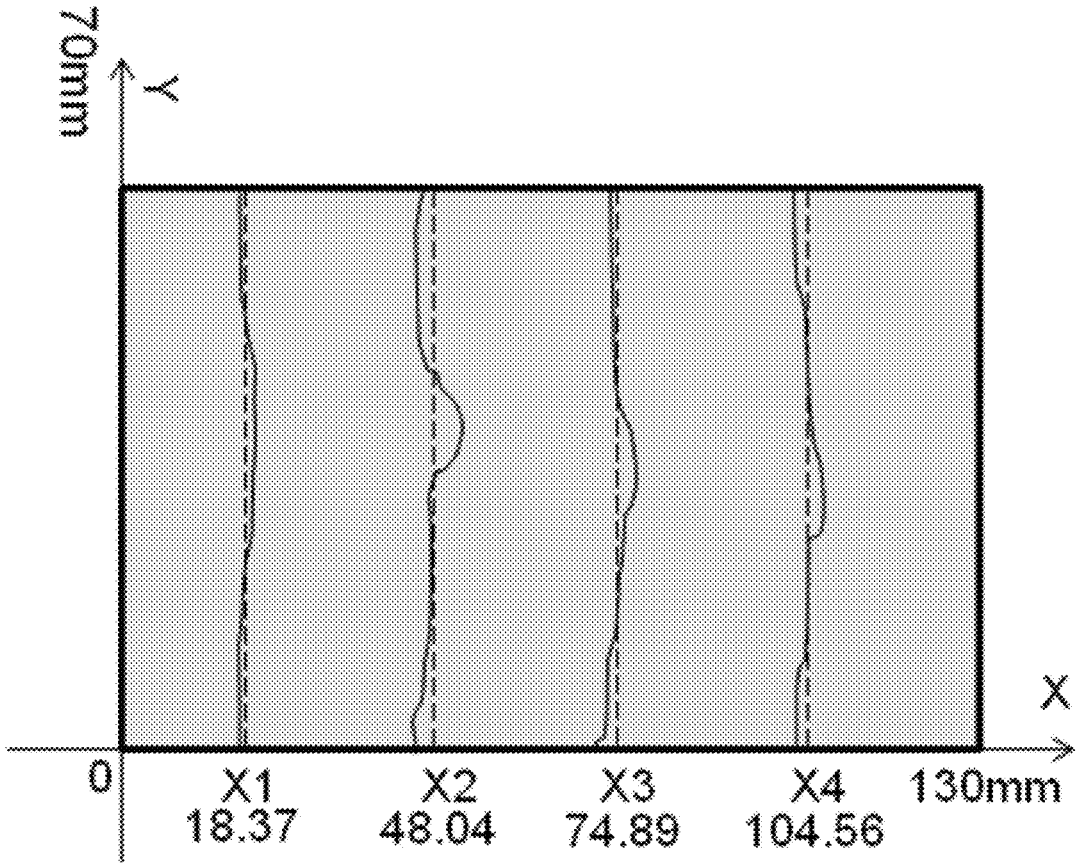
FIG. 5*c* is a schematic diagram showing average position coordinates for each of the lowest brightness curves.
Figure 5D:
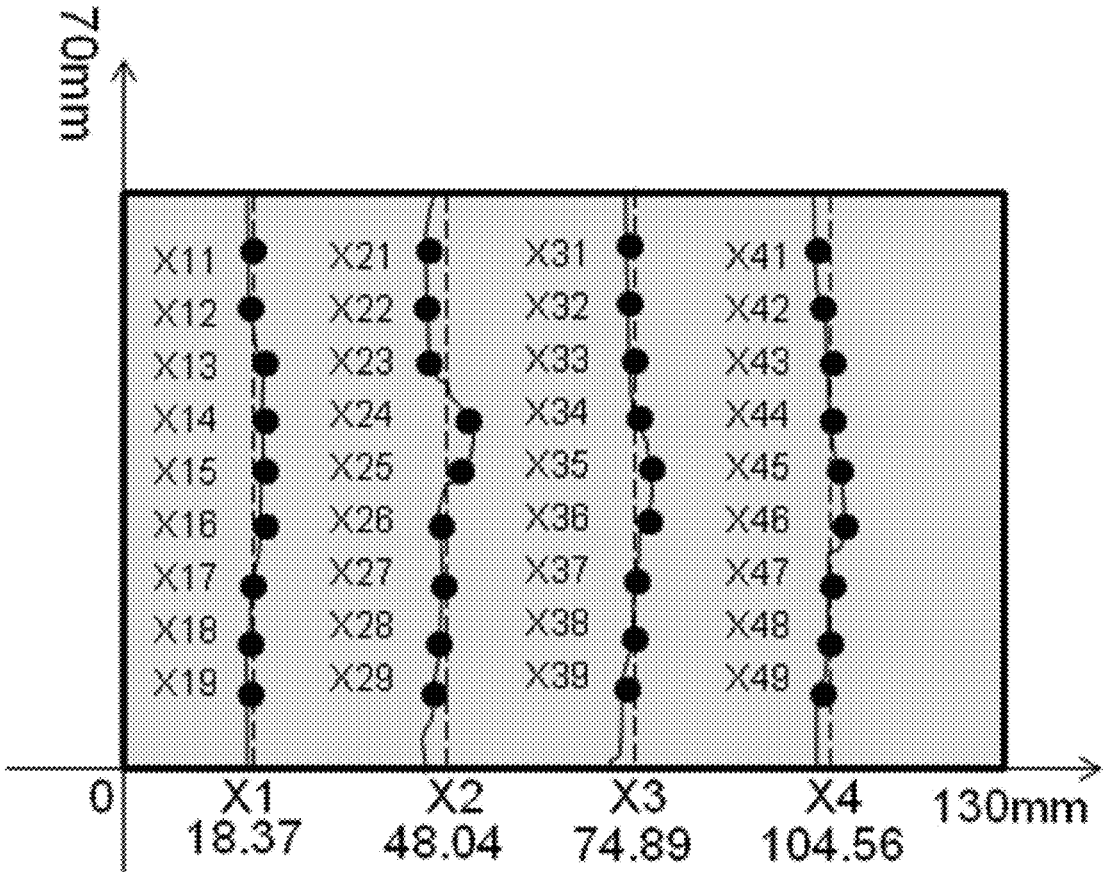
FIG. 5*d* is a schematic diagram showing deviations of lateral position coordinates of discrete points on each of the lowest brightness curves.
Figure 5E:
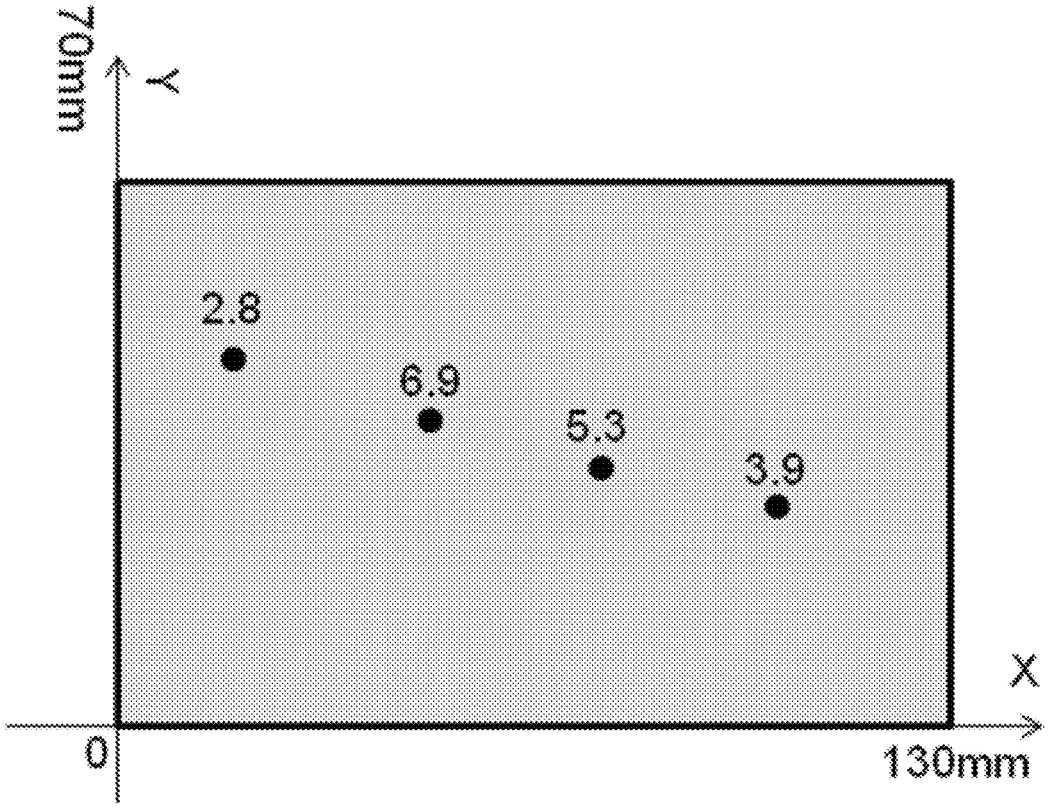
FIG. 5*e* is a schematic diagram showing the thickness abnormal position of the display screen.

For example, when detecting uniformity of thickness of a display screen by using the detecting system, firstly, a whole white color picture is displayed on the display screen, and then the lens center of the CCD is aimed at the screen central point of the display screen, and the CCD acquires the brightness image of the moire stripes, as shown in FIG. 5*a*. The CCD converts the brightness image into a digital signal and transfers to the control module. The control module extracts the lowest brightness curve for every moire stripe, that is, the curve made by connecting the darkest points on the lateral coordinate, as shown in FIG. 5*b*; calculates the lateral average position coordinates $X_1, X_2, X_3 \ldots X_n$ for every lowest brightness curve, as shown in FIG. 5*c*; calculates deviation values of the lateral position coordinates for nine discrete points provided on each of the lowest brightness curves with respect to the lateral average position coordinates, as shown in FIG. 5*d*; and determines whether or not the deviation values exceed a preset allowable deviation range, finds out the discrete point whose deviation value exceeds the allowable deviation range, determines the position of the discrete point as the thickness abnormal position of the display screen, as shown in FIG. 5*e*, and outputs the thickness abnormal position of the display screen by a display. Furthermore, the control module calculates the dispersion degrees $S_1, S_2, S_3, \ldots S_n$ with respect to each of the lowest brightness curves (the dispersion degree is equal to the variance of the deviation values of the nine discrete points), then calculates the average value $S_{average}$ of $S_1, S_2, S_3 \ldots S_n$; and determines the level of the uniformity of the thickness of the display screen according to the $S_{average}$, and outputs the level by the display.

The detecting system can quantitatively and qualitatively evaluate the state of the moire stripes, and determine the thickness abnormal position of the display screen and the level of the uniformity of the thickness of the display screen according to the state of the moire stripes, so that it is possible to accurately evaluate the performance of the product and significantly improve the controllability of the products.

It is apparent that an ordinary person in the art can make various variations and modifications to the present invention without departure from the spirit and the scope of the present invention, and if such variations and modifications belong to the claims and equivalent scope of the present invention, the invention is intended to include such variations and modifications.

The present application claims the priority of Chinese Patent Application No. 201410234495.4 filed on May 29, 2014, which is entirely incorporated herein by reference.

What is claimed is:

1. A detecting method for detecting a uniformity of a thickness of a display screen, comprising:

extracting a preset brightness curve for each of moire stripes when the display screen displays a monocolour picture;

calculating an average position coordinate in a preset direction for each of the preset brightness curves;

calculating a deviation value of a position coordinate in the preset direction of a discrete point on each of the preset brightness curves with respect to the average position coordinate; and for each of the preset brightness curves, when the deviation value exceeds a preset allowable deviation range, determining a thickness abnormal position of the display screen according to the position coordinate of the discrete points corresponding to the deviation value.

2. The detecting method according to claim 1, further comprising:

for each of the preset brightness curves, calculating a dispersion degree according to the deviation values;

calculating an average value of the dispersion degrees corresponding to each of the preset brightness curves; and determining a level of the uniformity of the thickness of the display screen according to the average value of the dispersion degrees.

3. The detecting method according to claim 2, wherein the monocolour picture is a white color picture.

4. The detecting method according to claim 2, wherein the preset brightness curves are lowest brightness curves.

5. The detecting method according to claim 2, wherein the preset brightness curves are lowest brightness curves.

6. The detecting method according to claim 1, wherein the monocolour picture is a white color picture.

7. The detecting method according to claim 6, wherein the preset brightness curves are lowest brightness curves.

8. The detecting method according to claim 1, wherein the preset brightness curves are lowest brightness curves.

9. The detecting method according to claim 1, wherein the preset direction is a lateral direction.

* * * * *